US012398534B2

(12) United States Patent
Kirby

(10) Patent No.: US 12,398,534 B2
(45) Date of Patent: Aug. 26, 2025

(54) EXCAVATION MACHINE HAVING A FRAME EQUIPPED WITH GUIDE WINGS

(71) Applicant: SOLETANCHE FREYSSINET, Rueil-Malmaison (FR)

(72) Inventor: Scott Kirby, Rueil-Malmaison (FR)

( * ) Notice: Subject to any disclaimer, the term of this patent is extended or adjusted under 35 U.S.C. 154(b) by 895 days.

(21) Appl. No.: 17/183,383

(22) Filed: Feb. 24, 2021

(65) Prior Publication Data

US 2021/0262192 A1 Aug. 26, 2021

(30) Foreign Application Priority Data

Feb. 25, 2020 (FR) ..... 20 01824

(51) Int. Cl.
*E02F 5/10* (2006.01)
*E02F 5/02* (2006.01)
*E02F 5/08* (2006.01)

(52) U.S. Cl.
CPC ..... *E02F 5/10* (2013.01); *E02F 5/025* (2013.01); *E02F 5/08* (2013.01)

(58) Field of Classification Search
CPC ... E02F 5/02; E02F 5/022; E02F 5/025; E02F 5/04; E02F 5/06; E02F 5/08; E02F 5/10; E02F 5/12; E02F 5/14; E02F 5/145; E02F 5/20; E02F 3/18; E02F 3/205; E02F 3/475; E02D 19/22; E02D 17/06; E02D 17/13
See application file for complete search history.

(56) References Cited

U.S. PATENT DOCUMENTS 2,013,070 A * 9/1935 Sheridan ..... E21B 19/22 91/218
2,637,527 A * 5/1953 Andrews, Jr. ..... E21B 47/024 175/45
3,894,587 A * 7/1975 Sourice ..... E02D 17/13 175/96
4,718,504 A * 1/1988 Terashima ..... E21B 7/001 175/102
4,930,940 A * 6/1990 Charlier ..... E02D 5/18 405/303
8,640,364 B2 2/2014 Arzberger et al.
(Continued)

FOREIGN PATENT DOCUMENTS

EP 0887474 A2 12/1998
EP 0919669 A2 6/1999
(Continued)

OTHER PUBLICATIONS

English language abstract of EP0887474.
English language abstract of EP0919669.

*Primary Examiner* — Christopher J Sebesta
*Assistant Examiner* — Audrey L Lusk
(74) *Attorney, Agent, or Firm* — Cabinet Beau de Loménie

(57) ABSTRACT

The disclosure concerns an excavation machine for making a trench into ground including a frame extending along a longitudinal direction, an excavation device disposed under the lower end part of the frame, the excavation machine further including at least a first guide device comprising at least a first guide flap protruding from a first lateral side of the frame outwardly of the frame, and wherein, considered in a plane perpendicular to the longitudinal direction, the first guide flap is inclined relative to the first lateral side.

24 Claims, 5 Drawing Sheets

(56) References Cited

U.S. PATENT DOCUMENTS

| | | | | |
|---|---|---|---|---|
| 2006/0225308 | A1* | 10/2006 | Arzberger | E02F 3/205 37/91 |
| 2007/0245599 | A1* | 10/2007 | Casagrande | E02D 17/13 37/189 |
| 2008/0066350 | A1* | 3/2008 | Humphries | E02D 17/13 701/50 |
| 2010/0307825 | A1* | 12/2010 | Siepi | E02F 3/26 702/9 |
| 2018/0245449 | A1* | 8/2018 | Raffuzzi | G01B 5/207 |

FOREIGN PATENT DOCUMENTS

| | | | | |
|---|---|---|---|---|
| EP | 1746213 | A1 * | 1/2007 | E02D 17/13 |
| EP | 1847653 | A1 | 10/2007 | |
| EP | 2378002 | A1 | 10/2011 | |
| EP | 3366844 | A1 | 8/2018 | |

* cited by examiner

[Fig. 1]
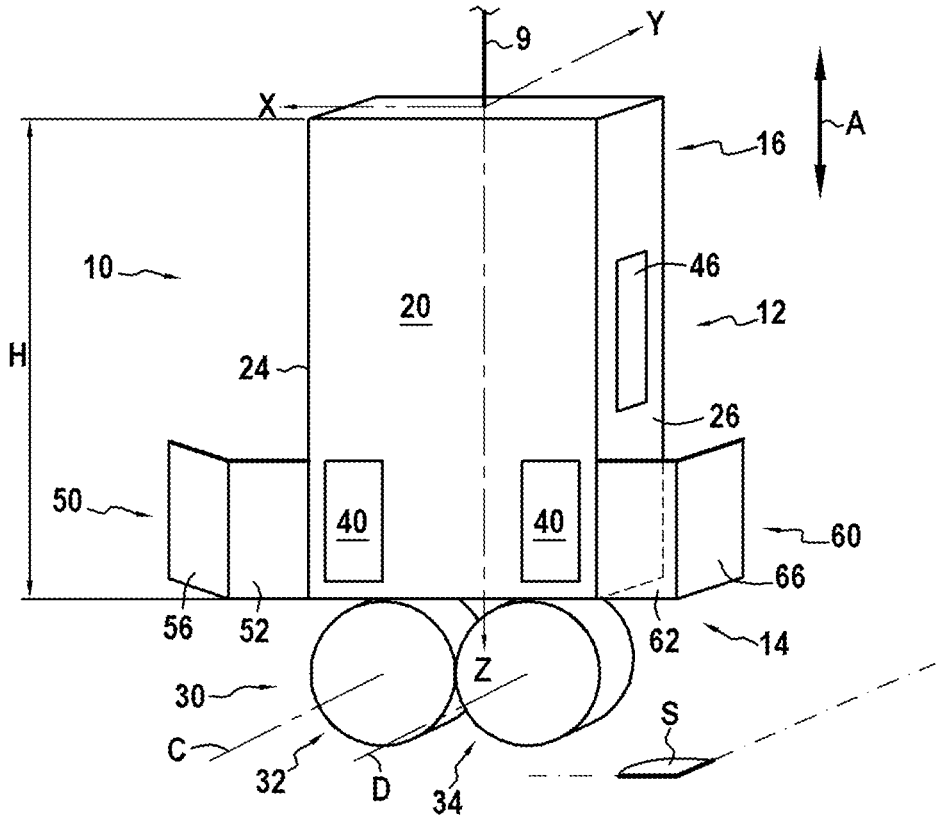
[Fig. 2]
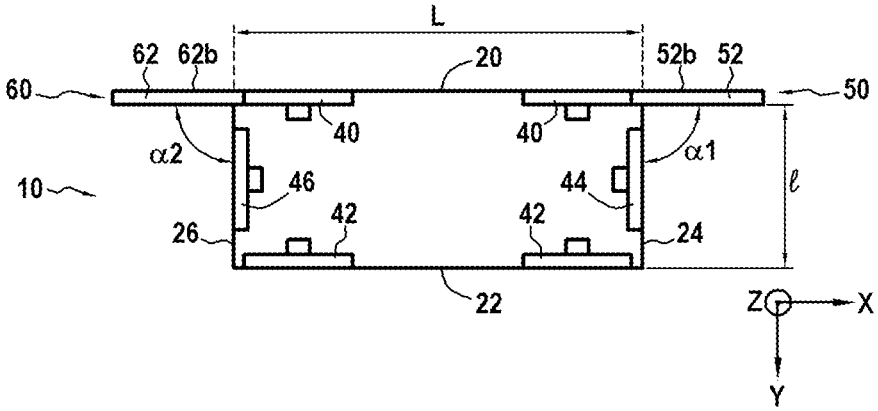

[Fig. 3]
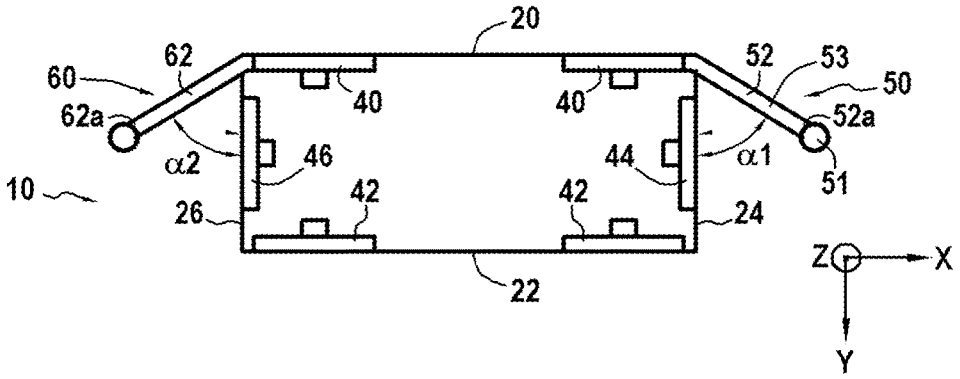
[Fig. 4]
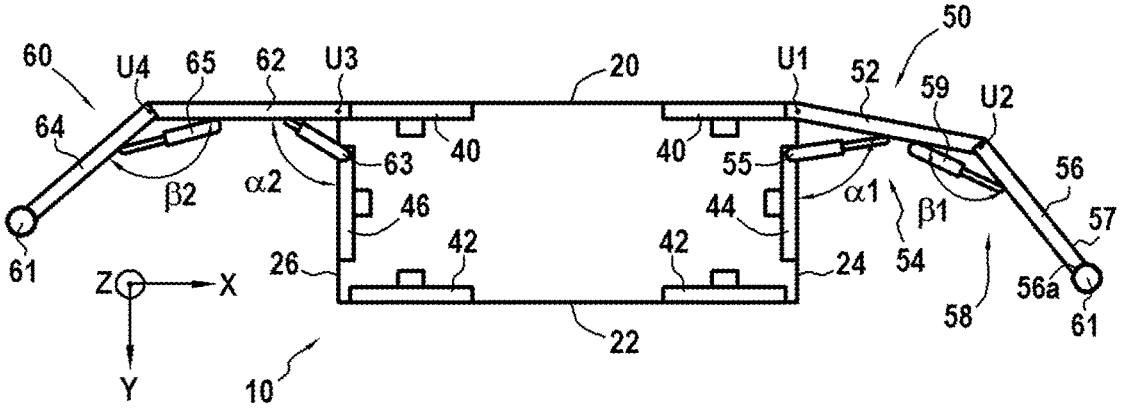
[Fig. 5A]
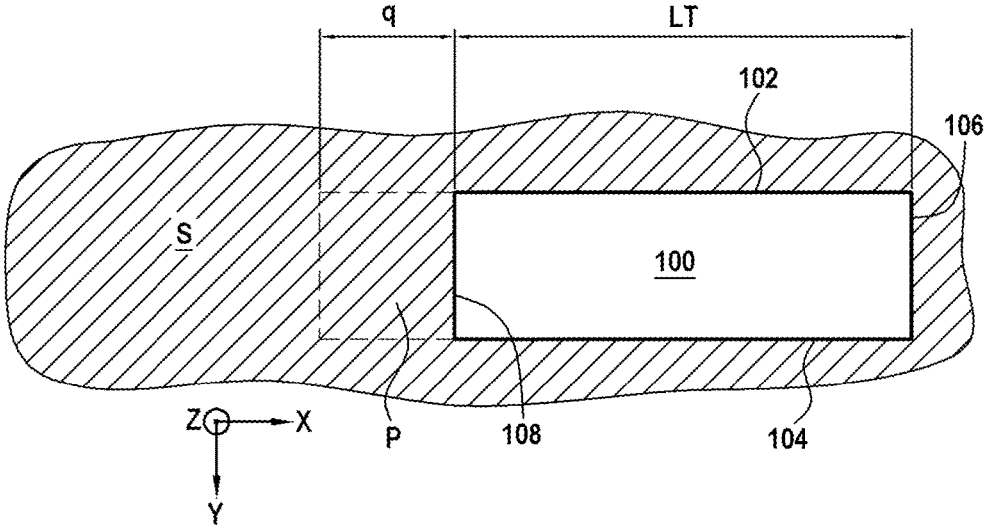

[Fig. 5B]
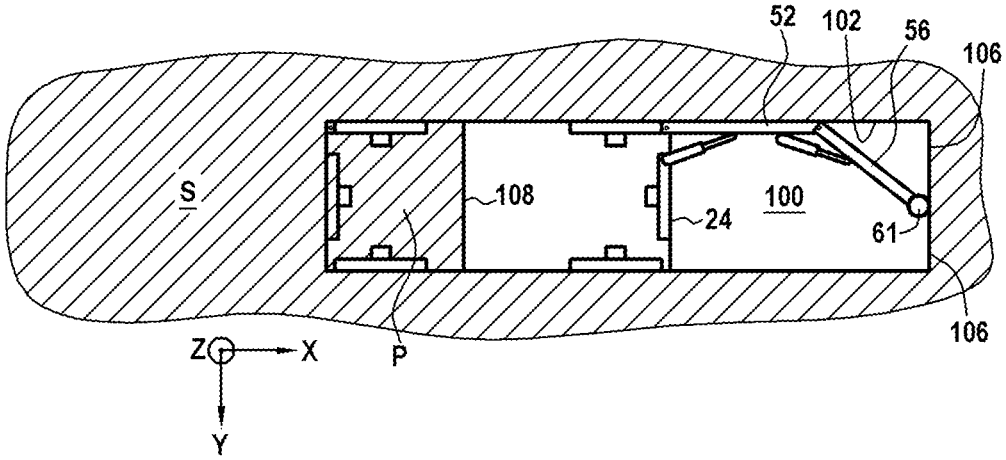
[Fig. 6A]
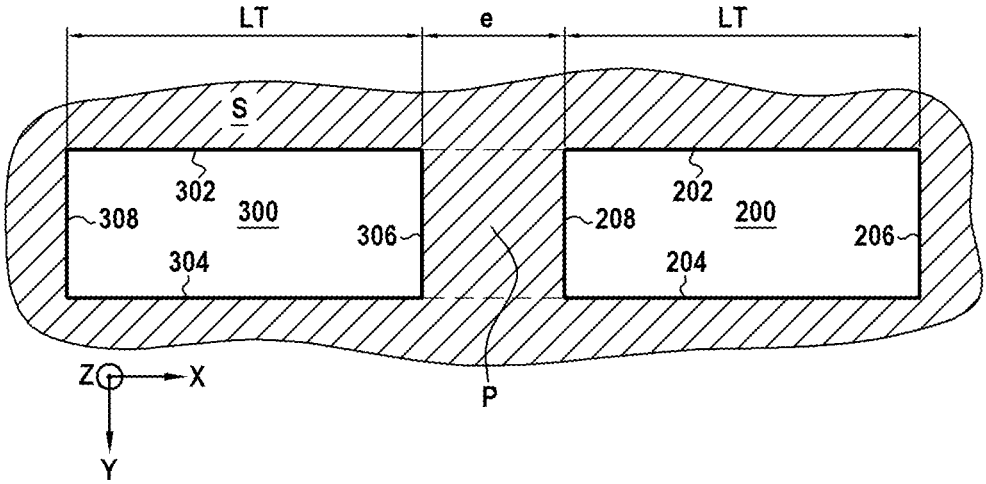
[Fig. 6B]
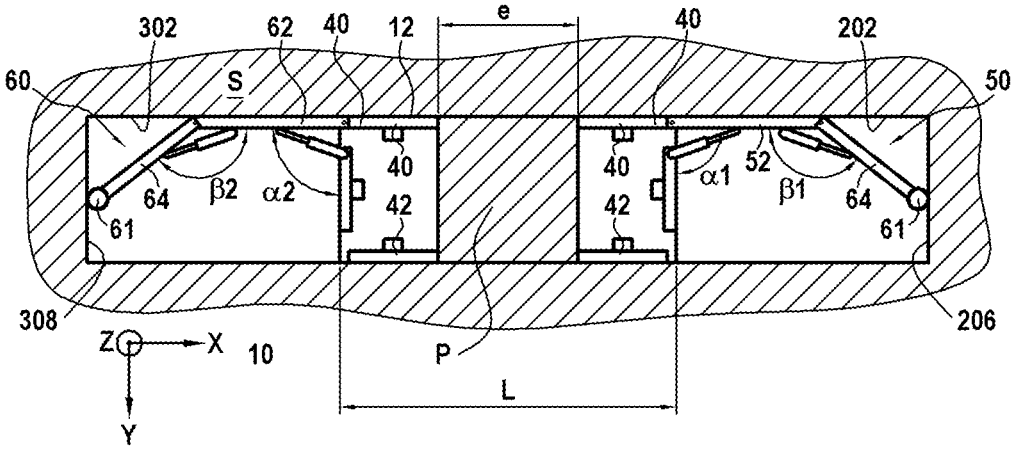

[Fig. 7A]
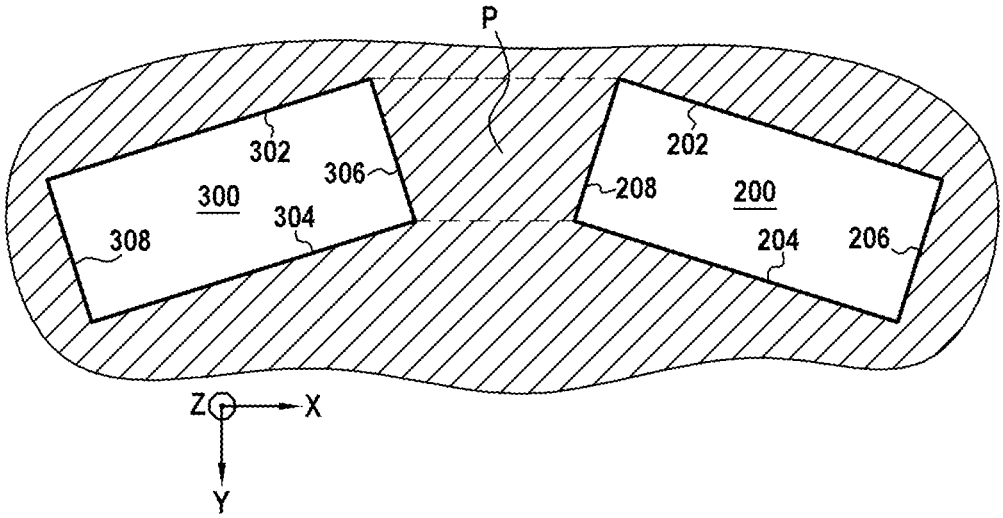
[Fig. 7B]
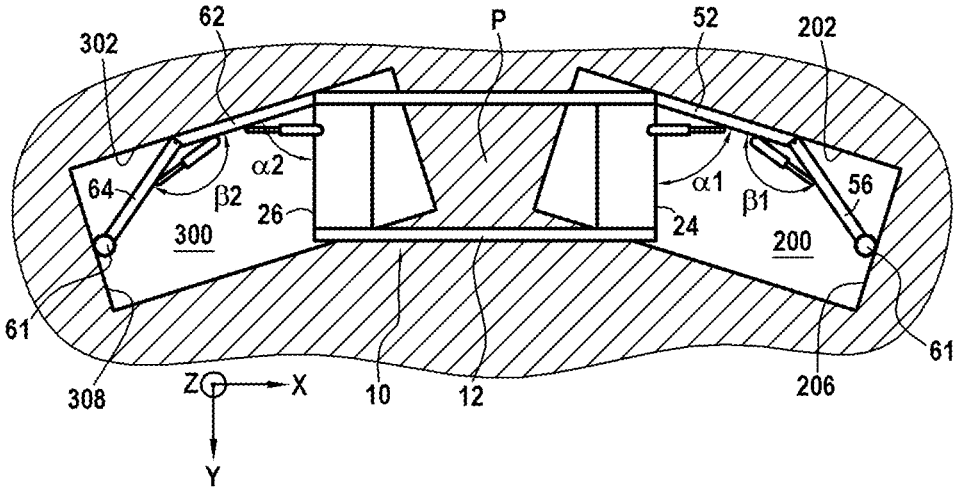

[Fig. 8]
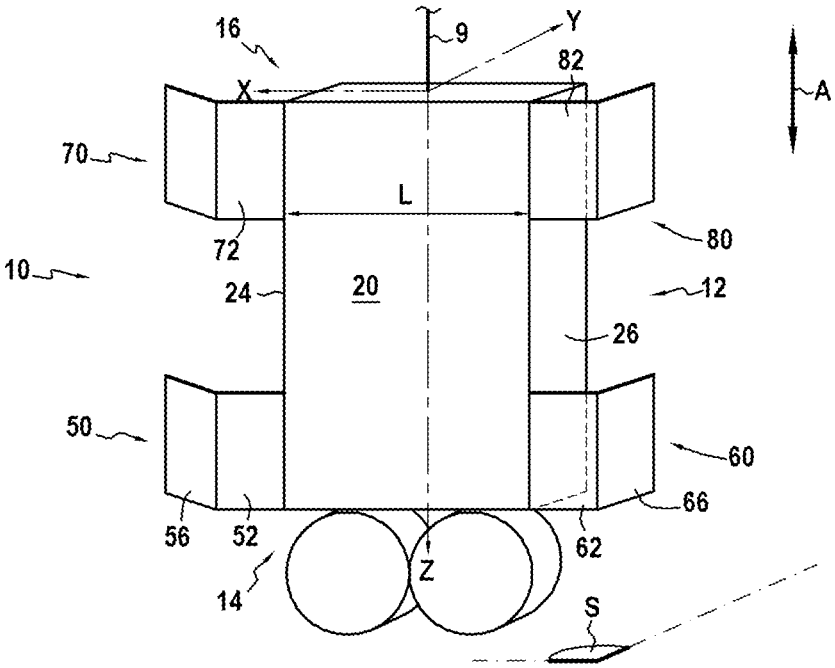
[Fig. 9]
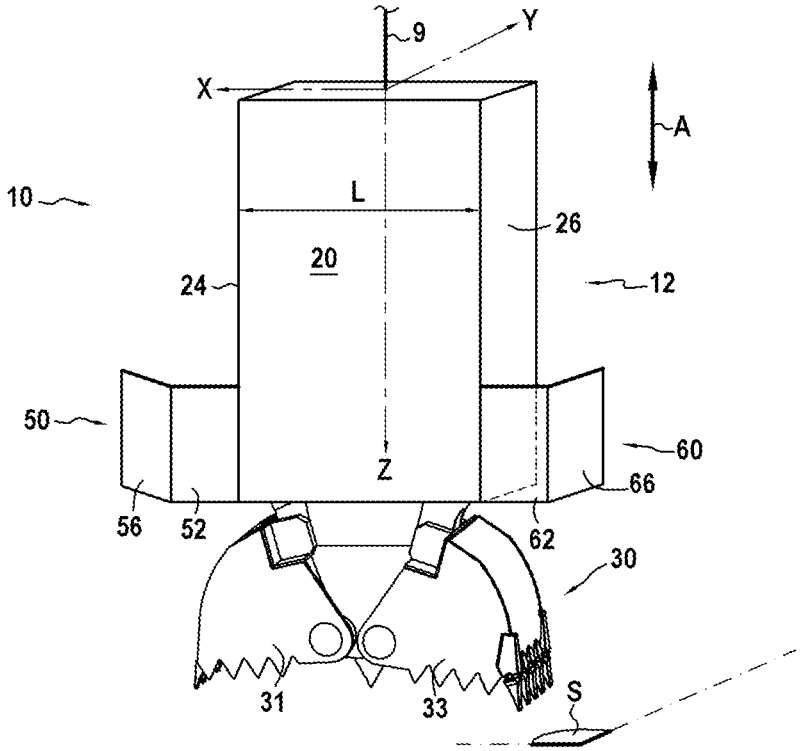

EXCAVATION MACHINE HAVING A FRAME EQUIPPED WITH GUIDE WINGS

TECHNICAL FIELD

The disclosure concerns the field of excavation of trenches into the ground, and of making screens in the ground, in particular diaphragm or prefabricated walls. It concerns particularly the techniques for making arcuate diaphragm walls in the ground.

BACKGROUND

For making trenches and screens in the ground, an excavation machine is generally used, which can be a drilling bucket equipped with scoops, or a milling cutter equipped with rotating cutting drums.

Such an excavation machine traditionally includes:

- a frame extending along a longitudinal direction between a lower end part and an upper end part, the frame having a first main side, a second main side opposite to the first main side, a first lateral side and a second lateral side opposite to the first lateral side, the first and second main sides and the first and second lateral sides extending along the longitudinal direction of the frame, the first and second lateral sides being transverse to the first and second main sides;
- an excavation device disposed under the lower end part of the frame.

The excavation device therefore most often includes a pair of scoops, when the excavation machine is a clamshell bucket, or a pair of rotating cutting drums, when the excavation machine is a milling cutter.

The trench made with such an excavation machine generally has a cross section, considered in a horizontal plane, of substantially rectangular shape. The trench has first and second main faces, which extend vertically while being parallel to each other, as well as first and second lateral faces which extend vertically, the lateral faces being smaller than the first and second main faces. The first and second main faces are perpendicular to the first and second lateral faces.

In order to make a continuous wall in the ground, a technique is known which consists in drilling a first trench, then a second trench at a distance from the first trench. The ground portion located between the first and second trenches, generally referred to as a merlon, is excavated during a third vertical drilling operation.

Most often, the merlon has a length—corresponding substantially to the distance between the first and second trenches—smaller than the length of the cross section of the excavation device, considered in said horizontal plane. It implies that during the vertical excavation of the merlon, the surface of the merlon is smaller than the leading surface of the excavation device. Since the excavation device is not bearing on its entire leading surface, this sometimes has the effect of deflecting the excavation machine towards either of the first and second trenches. Such a deflection is particularly inconvenient since it leads to a deflection in the drilling path and may damage the first and second trenches previously made. Such damage has the effect of generating overconsumption of concrete necessary to fill the areas over-excavated by the excavation device that has deflected. In order to counter this risk, it is necessary to regularly correct the orientation of the frame, which is time-consuming and affects productivity.

Such a deflection is even more problematic when making arched screens where the first and second trenches are not parallel to each other.

More generally, this problem arises when it is necessary to excavate a ground portion whose horizontal section is smaller than the leading surface of the excavation device.

SUMMARY

An aim of the present disclosure is to propose an excavation machine allowing limiting the deflections of the excavation device, in particular when drilling the merlon located between two previously excavated trenches. The excavation machine according to the disclosure therefore allows particularly improving the quality of making the diaphragm walls.

The excavation machine according to the disclosure achieves its aim by the fact that said excavation machine further includes at least a first guide device comprising at least a first guide flap protruding from the first lateral side of the frame outwardly of the frame, and considered in a plane perpendicular to the longitudinal direction of the frame, the first guide flap is inclined relative to the first lateral side.

During the excavation of the merlon, the first guide flap bears against one of the faces of a previously excavated trench, in order to avoid a deflection of the excavation device in the horizontal plane. Such a trench conventionally includes two large vertical main faces parallel to each other, and two small vertical lateral faces, parallel to each other and perpendicular to the large main faces.

The first guide flap therefore constitutes a lateral extension of the frame which bears against one of the faces of the trench. The first guide flap slides against the wall of the trench during the lowering of the frame into the ground. The first guide flap may extend substantially continuously from the frame, so as to form a continuous guide surface between the frame and the first guide flap.

The angle of inclination between the first guide flap and the first lateral side may be comprised between 0° and 90°, preferably but not exclusively between 45° and 90°. More generally, the angle of inclination can be chosen so that the first guide flap is parallel to the first main side or to the second main side.

Also, according to one embodiment of the disclosure, the first guide flap is parallel to the first main side of the frame. In this embodiment, the first guide flap bears against the first or second vertical main face of the trench, thereby preventing the frame from pivoting in a horizontal plane. The excavation machine according to the disclosure therefore allows preventing a deflection of the excavation device, in particular by pivoting in a horizontal plane.

It is therefore understood that, in the use position, the first guide flap is fixed relative to the frame.

At least one of the first and second main sides of the frame may comprise a guide member arranged to bear against a main face of the trench, and the first guide flap and the guide member are coplanar. It is understood that the first guide flap and the guide member have bearing faces against a wall of the trench extending in the same plane. The guide member, also known, may for example consist of one or several plates or uprights which are configured to slide along the main face of the trench during the lowering of the excavation machine into the ground.

Advantageously, the first guide flap is mounted on the frame to pivot about a first axis parallel to the longitudinal direction, the first guide device further comprising a first locking device to rotatably lock the first guide flap relative to the first lateral side. The first locking device prevents the rotation of the first guide flap relative to the first lateral side.

One advantage is being able to fold back the first guide flap against the first lateral side. Thus, it is possible to drill the trench without having to remove the first guide device from the frame. Another advantage from the pivotal mounting is to be able to set the angle of inclination of the first guide flap relative to the first lateral side, whereby the same excavation machine can be used to make different types and shapes of walls, in particular arched or cylindrical walls. Advantageously, a single excavation machine can therefore be used on a construction site to make walls having different configurations.

The excavation machine according to the disclosure may further include a first cylinder for pivoting the first guide flap relative to the first lateral side. The cylinder can be controlled remotely by an operator. It may be of the hydraulic, electric or even manually actuated type. The cylinder can also be used as the first locking device.

Advantageously, the first guide flap includes a plate, which may be a planar plate, which is parallel to the longitudinal direction of the frame, and the plate may bear against one of the main faces of the trench.

According to a preferred embodiment, the first guide flap is disposed at the lower end part of the frame. The first guide flap therefore may extend from a lower end part of the first lateral side of the frame.

According to one variant, the first guide device further includes a pad disposed on a lateral edge of the first guide flap, the pad being provided to bear against a lateral face of a trench. The pad may extend along the lateral edge of the first guide flap. It allows for linear bearing against said lateral edge or against a longitudinal seal of the CWS type when it is present.

According to another embodiment, the first guide device further comprises a second guide flap connected to the first guide flap, so that the first guide flap is disposed between the frame and the second guide flap.

It is understood that the second guide flap constitutes a lateral extension of the first guide flap. The second guide flap may be secured to the first guide flap. The second guide flap may form with the first guide flap a single piece which may be mounted removably to the frame.

Considered in a plane perpendicular to the longitudinal direction of the frame, the second guide flap may be inclined relative to the first guide flap. Such a conformation allows increasing the possible bearing areas on the walls of the adjacent trenches.

The second guide flap may be mounted on the first guide flap to pivot about a second axis parallel to the first axis, the second guide device further comprising a second locking device to rotatably lock the second guide flap relative to the first guide flap. The second locking device prevents the rotation of the first guide flap relative to the second guide flap.

The first and second locking devices can be actuated independently, in order to adapt the guide device to the configuration of the adjacent trenches.

The first and second guide flaps may be retractable so as to be masked when the excavation machine is used to drill the first or second trench. The first and second guide flaps are therefore deployed during the drilling of the ground portion constituting the merlon.

The excavation machine according to the disclosure may comprise a second cylinder for pivoting the second guide flap relative to the first guide flap. Like the first cylinder, the second cylinder can be controlled remotely or be of the manual type.

Like the first guide flap, the second guide flap may include a plate, which may be a planar plate, which is parallel to the longitudinal direction of the frame.

The first guide device further may include a pad disposed on a lateral edge of the second guide flap, the pad being provided to bear against a lateral face of a trench.

According to another embodiment, the excavation machine according to the disclosure further comprises a second guide device comprising at least a third guide flap protruding relative to the second lateral side of the frame outwardly of the frame and, considered in a plane perpendicular to the longitudinal direction of the frame, the third guide flap is inclined relative to the second lateral side of the frame.

It is understood that the first and third guide flaps are disposed on either side of the frame.

According to a preferred exemplary embodiment, the third guide flap is protruding from the lower part of the frame. Also, the first and third guide flaps may both be disposed at the lower part of the frame. The second guide device may include an additional guide flap, similar to the second guide flap, and connected to the third guide flap According to another embodiment, the excavation machine according to the disclosure further comprises a third guide device equipped with a fourth guide flap protruding relative to the first or second lateral side of the frame outwardly of the frame and, considered in a plane perpendicular to the longitudinal direction of the frame, the fourth guide flap is inclined relative to the first or the second lateral side of the frame, the fourth guide flap protruding from the upper part of the frame.

According to one embodiment, the excavation machine is of the bucket type and the excavation device includes a pair of movable scoops.

According to another embodiment, the excavation machine is a milling cutter and the excavation device includes at least one cutting drum which is rotatable about an axis of rotation perpendicular to the first main side of the frame.

The disclosure also concerns a method for drilling a ground, in which:

- a first trench is vertically drilled into the ground, the first trench having a first main face which is vertical as well as a first lateral face which is vertical and orthogonal to the first main face; then
- a ground portion is vertically drilled into the ground using the excavation machine according to the disclosure, the first guide flap bearing against the first main face of the first trench during the drilling of the ground portion.

Finally, the disclosure concerns a method for drilling a ground, in which:

- a first trench is vertically drilled into the ground, the first trench having a first main face and a first lateral face which is orthogonal to the main face; then
- a ground portion is vertically drilled using the excavation machine according to the disclosure, the second guide flap bearing against the first main face and/or against the first lateral face of the first trench during the drilling of the ground portion.

It is understood that the contact between the second guide flap and the first main face and/or against the first lateral face of the first trench allows preventing a deflection of the frame, in particular during the drilling of the merlon.

Advantageously, after having drilled the first trench and before drilling the ground portion, a second trench is vertically drilled into the ground, said second trench being separated from the first trench by the ground portion.

During the vertical drilling of the ground portion, an excavation machine equipped with the first and second guide devices may be used, so as to maintain the orientation of the frame relative to the faces of the first and second trenches.

Considered in a horizontal plane, the first and second trenches may be inclined relative to each other.

DESCRIPTION OF THE DRAWINGS

The disclosure will be better understood upon reading the following description of embodiments of the disclosure given by way of non-limiting examples, with reference to the appended drawings, in which:

FIG. 1 is a schematic perspective view of an excavation machine according to one embodiment of the disclosure;

FIG. 2 is a top view of an excavation machine according to a first embodiment of the disclosure;

FIG. 3 is a top view of the excavation machine of FIG. 1, the guide flaps being inclined relative to the main face of the frame;

FIG. 4 is a top view of an excavation machine according to a second embodiment of the disclosure where the guide devices include several flaps;

FIG. 5A illustrates, in top view, a trench excavated into the ground and a ground portion to be excavated;

FIG. 5B illustrates, in top view, the drilling of the ground portion of FIG. 5A;

FIG. 6A illustrates, in top view, first and second trenches parallel to each other and separated from each other by a merlon;

FIG. 6B illustrates the drilling of the merlon of FIG. 6A using the machine according to the disclosure;

FIG. 7A illustrates, in top view, the first and second trenches inclined relative to each other and separated from each other by a merlon;

FIG. 7B illustrates the drilling of the merlon of FIG. 7A using the excavation machine according to the disclosure;

FIG. 8 is a schematic perspective view of a milling cutter-type excavation machine according to another embodiment of the disclosure; and FIG. 9 is a schematic perspective view of a bucket-type excavation machine according to an exemplary embodiment of the disclosure.

DESCRIPTION OF THE EMBODIMENTS

Several embodiments of an excavation machine 10 will now be described according to the disclosure which allows making vertical trenches in a ground S. In a known manner, such an excavation machine is used within the framework of manufacturing diaphragm walls in the ground, these walls being in a rectilinear, arched or even circular shape.

This excavation machine includes a frame 12 extending along a longitudinal direction A between a lower end part 14 and an upper end part 16. In the reference frame (X, Y, Z) represented in the figures, it is understood that the longitudinal direction A extends along the Z axis.

Considered in a horizontal plane XY, it is observed in FIG. 2 that the frame includes a length L, which extends along the X axis, and a width I which extends along the Y axis.

The frame 12 includes a first main side 20 which extends in the vertical plane XZ. The frame 12 further includes a second main side 22 which is opposite and parallel to the main side 20. It is understood that the distance between the first and second main sides 20, 22 corresponds to the width I.

The frame 12 further includes a first lateral side 24 which extends in the vertical plane YZ. The frame includes a second lateral plane 26 which is opposite and parallel to the first lateral side 24.

The distance between the first and second lateral sides 24, 26 corresponds to the length L of the frame. The frame 12 also has a height H which extends along the Z axis.

As will be understood, the first and second main sides 20, 22 and the first and second lateral sides 24, 26 extend along the longitudinal direction A of the frame 12. Furthermore, the first and second lateral sides 24, 26 are transverse, particularly perpendicular to the first and second main sides 20, 22.

The excavation machine 10 further includes an excavation device 30 which is disposed under the lower end part 14 of the frame 12. In this first embodiment, the excavation device 30 includes two cutting drums 32, 34, also known, which are rotatable about axes of rotation C and D parallel to each other and perpendicular to the first main side 20 of the frame 12. The excavation device 30 also includes hydraulic motors also known which, in this example, are integrated in the cutting drums 32, 34.

The excavation machine 10 is suspended on a lift cable 9 which is connected to the upper end part 16 of the frame 12. The frame 12 furthermore includes guide members 42 which for their part extend along the second main side 22. The frame 12 furthermore includes third guide members 44 which extend along the first lateral side 24 and fourth guide members 46 which extend along the second lateral side 26. These guide members 40, 42, 44, 46 are also known and will not be described in more detail here.

The first, second, third and fourth guide members 40, 42, 44, 46 serve to guide the vertical movement of the frame by bearing against the faces of the trench.

According to the disclosure, the excavation machine 10 further includes a first guide device 50 whose function is to guide the vertical movement of the frame, by bearing against a wall of an adjacent trench.

The first guide device 50 includes, in this example, a first guide flap 52 which is protruding from the first lateral side 24 of the frame 12 outwardly of the frame.

It is observed that, considered in a horizontal plane XY perpendicular to the longitudinal direction A of the frame 12, the first guide flap 52 is inclined relative to the first lateral side 24. The angle of inclination is referenced $\alpha 1$ in the figures.

As observed in FIG. 1, the angle $\alpha 1$ is equal to approximately 90°, so that the first guide flap 52 is parallel to the first main side 20 of the frame 12.

The first guide flap 52 and the first guide member 40 are coplanar. More specifically, the first guide flap 52 and the first guide member 40 have bearing faces which extend in the same plane.

In the example of FIG. 3, the angle of inclination $\alpha 1$ between the first guide flap 52 and the first lateral side 24 is on the order of 45°.

In the example of FIG. 4, the first guide flap 52 is mounted on the frame 12 to pivot about a first axis U1 which is parallel to the longitudinal direction A, in other words the axis U1 extends along the Z axis of the reference frame. In this variant, the angle of inclination $\alpha 1$ between the first guide flap 52 and the first lateral side 24 which is therefore adjustable by pivoting of the first axis U1. To this end, the first guide device 50 further includes a first locking device 54 to rotatably lock the first guide flap 52 relative to the first lateral side 24. In this example, the first locking device 54 consists of a first cylinder 55, which also has the function of pivoting the first guide flap 52 relative to the first lateral side 24. This first cylinder 55 can be manual or actuated by electric or hydraulic means. The pivoting amplitude of the first guide flap 52 relative to the first lateral side 24 is included between 0°, position in which the first guide flap 52 is folded back against the lateral side 54, and approximately 90°, position in which the first guide flap 52 is parallel to the first guide member 40). This amplitude may be between 45° and 90°.

In the exemplary embodiment of FIGS. 1 to 4, the first guide flap 52 includes a plate 53, which is planar and which is parallel to the longitudinal direction of the frame, in other words this plate 53 is located in a vertical plane which is either parallel to the plane of the first main side or inclined relative thereto. Referring to FIG. 1, it is also observed that the first guide flap 52 is disposed at the lower end part 14 of the frame 12.

Referring again to the example of FIG. 3, it is observed that the first guide device 50 further includes a pad 51 disposed on a lateral edge 52*a* of the first guide flap 52. The pad 55 is provided to bear on a lateral face of a trench. In the exemplary embodiments illustrated in FIGS. 1 and 4, the first guide device 50 further includes a second guide flap 56 which is connected to the first guide flap 52 so that the first guide flap 52 is disposed between the frame 12 and the second guide flap 56. In these two examples, the second guide flap 56 is juxtaposed with the first guide flap 52. According to one variant, not illustrated here, the first and second flaps 52, 26 may be parallel.

In the examples of FIGS. 1 and 4, considered in projection in a plane XY perpendicular to the longitudinal direction of the frame 12, the second guide flap 56 is inclined by an angle β1 relative to the first guide flap 52. This angle β1 is therefore included between 0° and 180°. It is understood that when the angle β1 is equal to 180°, the first and second guide flaps 52, 56 are parallel to each other.

In the exemplary embodiment of FIG. 4, the second guide flap 56 is mounted on the first guide flap 52 to pivot about a second axis U2 which is parallel to the first axis U1. The second guide device includes a second locking device 58 to rotatably lock the second guide flap 56 relative to the first guide flap 52.

In this example, the second locking flap 58 includes a second cylinder 59, similar to the first cylinder 55, this second cylinder 59 also having the function of pivotally moving the second guide flap 56 relative to the second guide flap 52. The second cylinder 59 therefore allows orienting and locking the second guide flap 56 relative to the second guide flap 52.

The second guide flap 56 includes a plate 57, which is planar, parallel to the longitudinal direction of the frame. The plate 57 also lies in a vertical plane.

The first guide device 50 further includes a pad 61, similar to the pad 51 previously described, which is disposed on a lateral edge 56*a* of the second guide flap 56, the pad being provided to bear against a lateral face of a trench as will be explained below. In this example, the pad extends vertically and is fitted to the lateral edge 56*a*.

In the embodiments of FIGS. 1 to 4, the excavation machine further includes a second guide device 60 which includes a third guide flap 62 protruding relative to the second lateral side 26 of the frame 12. The third guide flap is protruding outwardly of the frame from the lower part of the frame. Without departing from the framework of the present disclosure, the third guide flap 62 could alternatively be protruding from the upper part 16 of the frame.

As observed in FIGS. 1 to 4, the structure of the second guide device 60 is similar to that of the first guide device 50. Without departing from the framework of the present disclosure, the second guide device 60 could have a shape or a number of guide flaps different from the first guide device 50.

Like the first guide device 50, the second guide device 60 is shaped such that, considered in an plane XY perpendicular to the longitudinal direction A of the frame 12, the third guide flap 62 is inclined by a angle α2 relative to the second lateral side 26 of the frame 12.

In the example of FIG. 2, the angle α2 is substantially equal to 90ϰ so that the third guide flap 62 is parallel to the main side of the frame 12, while being parallel to the first guide flap 52. More exactly, in the example of FIG. 2, the first and second guide flaps 52, 62 have bearing faces 52*b* and 62*b* which are coplanar.

In the example of FIG. 3, the angle of inclination α2 of the third guide flap 62 relative to the second lateral side 26 is on the order of 45°, is similar to the angle α1. Here again, the third guide flap 62 is pivotable relative to the frame about an axis of rotation U3 parallel to the axis of rotation U1, so that the angle of inclination α2 is adjustable. In this example, a cylinder 63, similar to the first cylinder 54 is provided in order to set the inclination α2, and immobilize the third guide flap 62 relative to the frame 12.

In the embodiment of FIG. 4, the second guide device further includes an additional guide flap 64 which is rising and pivotable relative to the third guide flap 62 about an axis of rotation U4 which parallel to the axis of rotation U3. The angle of inclination β2 between the additional guide flap 64 and the third guide flap 62 is adjustable using a cylinder 65 similar to the second cylinder 59 of the first guide device 50.

In this example, the additional guide flap 64, which extends in a vertical plane, is also equipped with a pad 61.

FIG. 8 illustrates another embodiment of the excavation machine according to the disclosure. In this embodiment, the excavation machine 10 further includes a third guide device 70 which is equipped with a fourth guide flap 72 which is protruding relative to the first lateral side 24 of the frame 12 outwardly of the frame. As can be understood from FIG. 10, in this example, the first and fourth guide flaps 52, 72 extend essentially in the same vertical plane.

Moreover, considered in a plane XY perpendicular to the longitudinal direction A of the frame, the fourth guide flap 72 is inclined relative to the first lateral side of the frame, the fourth guide flap is protruding from the upper part 16 of the frame. In this example, the third guide device 70 is similar to the first guide device 50, except that it is disposed at the upper part of the frame. In the example of FIG. 8, the excavation machine 10 further includes a fourth guide device 80, protruding from the upper part 16 of the frame, which includes a fifth guide flap 82 which is also protruding relative to the second lateral side 26 of the frame outwardly of the frame. Again, considered in a plane XY perpendicular to the longitudinal direction A of the frame, the fifth guide flap 82 is inclined relative to the second lateral side 26 of the frame 12, the fifth guide flap 82 protruding from the upper part of the frame.

It is also observed in FIG. 8 that the first, fourth and fifth guide flaps 72, 82 extend substantially in the same vertical plane.

FIG. 9 illustrates an excavation machine 10 according to a variant of that of FIG. 1. In FIG. 9, the excavation machine is a bucket. Its excavation device 30 includes a pair of mobile scoops 31, 33, also known.

With FIGS. 5 to 7, several modes of implementation of a method for drilling a ground according to the disclosure will now be described.

According to FIGS. 5A, 5B, a first mode of implementation for drilling a ground S is illustrated. These two figures, a ground S in top view are illustrated. According to the method, a first trench 100 having a main face 102 which is vertical as well as a second main face 104 parallel to the first main face 102 are vertically drilled into the ground. The first trench 100 further includes a second lateral face 108 which is parallel to the first lateral face 106; the first and second lateral faces 106, 108 being perpendicular to the first and second main faces 102, 104.

Then, in a second step, a ground portion P is vertically drilled into the ground using the excavation machine of FIG. 4 by having previously folded back or removed the second guide device 60. Considered along the X axis, the length q of the ground portion P is much smaller than the length LT of the trench 100.

The excavation machine, whose excavation device is disposed in a cantilevered manner on the ground portion P, is guided during its vertical movement by the first guide flap 52 which bears against the first main face 102 of the first trench 100. Furthermore, the second guide flap 56 bears through its lateral edge 56*a* equipped with the pad 61 against the first lateral side 106. The guide device 50, via the first and second guide flaps 52, 56 allows preventing the excavation machine 10 from deflecting along the direction X during the drilling of the portion P. Indeed, insofar as the surface, considered in a horizontal plane XY of the ground portion P is smaller than the cutting surface of the excavation device 30, the excavation machine 10 may, in the absence of the first guide device 50, deflect along the direction X. In other words, the first guide device 50 allows maintaining the excavation machine correctly oriented in the ground in order to maintain the desired drilling direction.

With FIGS. 6A and 6B, a variant of the mode of implementation of FIGS. 5A and 5B described above will be described.

According to the drilling method described in FIGS. 6A and 6B, a first trench 200 is vertically drilled into the ground S, the first trench having a first main face 202, a second main face 204 parallel to the first main face, a first lateral face 206 orthogonal to the first main face 202 and a second lateral face 208 parallel to the first lateral face 206.

After having drilled the first trench 200, and before drilling the ground portion P, a second trench 300 is vertically drilled into the ground, said second trench 300 being separated from the first trench by the ground portion P. As observed in FIG. 6A, the first trench 200 and the second trench 300 have first main faces 202, 302, which are parallel to each other, and may be coplanar. The ground portion P is generally called "merlon".

It is also observed that, considered along the X axis, the length e of the ground portion P is smaller than the length LT of the first and second trenches 200, 300.

The second trench 300 also includes first and second main faces 302, 304 and first and second lateral faces 306, 308.

In FIG. 6B, the excavation of the portion P is illustrated using the excavation machine 10 according to FIG. 4.

The excavation machine 10 is lowered vertically in line with the ground portion P to be excavated. As observed in FIG. 6B, the length L of the frame 12 of the excavation machine 10 is substantially greater than the length e of the ground portion P.

During the drilling of the ground portion P, the first and second guide devices 50, 60 are deployed so that the first guide flap 52 bears against the first main face 202, the pad 61 of the second guide flap 56 bears against the first lateral face 206, the third guide flap 62 (of the second guide device 60) bears against the first main face 302 of the second trench 300 while the pad 61 of the additional guide flap 64 of the second device guide 60 bears against the second lateral face 308 of the second trench 300.

This configuration allows preventing unintended movement of the excavation machine in the direction X, thanks to the pads 59 which bear against the lateral faces 206, 308 of the first and second trenches, and also prevents rotation of the frame about the Z axis thanks to the bearing of the first and third guide flaps 52, 62 against the first main faces of the first and second trenches.

According to a variant, not illustrated, the second guide flap 56 can also bear against the first main face 202 of the first trench 200, likewise the additional guide flap 64 could bear against the first main face 302 of the second trench 300.

The mode of implementation of FIGS. 7A and 7B differs from that of FIGS. 6A and 6B by the fact that the first and second trenches are, considered in the horizontal plane XY, inclined relative to each other. This means in particular that the first lateral faces 202, 302 of the first and second trenches 200, 300 are not parallel. The ground portion P located between the first and second trenches 200, 300 has a trapezoidal shape. The benefit from such a disposition is to form an arched wall element.

The first and second guide devices 50, 60 are deployed in the same way as in the embodiment illustrated in FIG. 6B, so that the first and third guide flaps 52, 62 bear against the first main faces 202, 302 of the first and second trenches 200, 300, while the pads 59 of the first and second guide devices respectively bear against the first lateral face 206 of the first trench and the second lateral face 308 of the second trench.

In this conformation, the angles of inclination $\alpha 1$ and $\alpha 2$ of the first and third guide flaps 52, 62 relative to the first and second sides 24, 26 of the frame 12 are less than 90°. As explained above, the angles of inclination $\alpha 1$ and $\alpha 2$ are adjusted by actuating the cylinders 54 and 63.

The invention claimed is:

1. An excavation machine for making a trench in a ground including:

a frame extending along a longitudinal direction between a lower end part and an upper end part, the frame having a first main side, a second main side opposite to the first main side, a first lateral side and a second lateral side opposite to the first lateral side, the first and second main sides and the first and second lateral sides extending along the longitudinal direction of the frame, the first and second lateral sides being transverse to the first and second main sides;

an excavation device disposed under the lower end part of the frame;

wherein said excavation machine further includes at least a first guide device comprising at least a first guide flap that includes a plate that protrudes from the first lateral side of the frame outwardly of the frame, said plate being configured to bear against a face of a previously excavated trench in order to keep the frame at a constant distance from said face, thereby preventing a deflection of the excavation device in a horizontal plane, wherein, considered in a plane perpendicular to the longitudinal direction of the frame, the plate of the first guide flap is inclined relative to the first lateral side, and wherein the plate of the first guide flap is mounted on the frame to pivot about a first axis parallel to the longitudinal direction, the first guide device further comprising a first locking device to rotatably lock the plate of the first guide flap relative to the first lateral side to prevent the rotation of said plate relative to said first lateral side, thereby keeping the plate of the first guide flap at a constant inclination relative to the first lateral side of the frame.

2. The excavation machine according to claim 1, wherein the first guide flap is parallel to the first main side of the frame.

3. The excavation machine according to claim 2, wherein at least one of the first and second main sides of the frame comprises a guide member arranged to bear against a main face of the trench, and wherein the first guide flap and the guide member are coplanar.

4. The excavation machine according to claim 1, comprising a first cylinder for pivoting the first guide flap relative to the first lateral side.

5. The excavation machine according to claim 1, wherein the plate of the first guide flap is parallel to the longitudinal direction of the frame.

6. The excavation machine according to claim 1, wherein the first guide flap is disposed at the lower end part of the frame.

7. The excavation machine according to claim 1, wherein the first guide device further includes a pad disposed on a lateral edge of the first guide flap, the pad being provided to bear against a lateral face of a trench.

8. The excavation machine according to claim 1, wherein the first guide device further comprises a second guide flap connected to the first guide flap so that the first guide flap is disposed between the frame and the second guide flap.

9. The excavation machine according to claim 8, wherein, considered in a plane perpendicular to the longitudinal direction of the frame, the second guide flap is inclined relative to the first guide flap.

10. The excavation machine according to claim 8, wherein the second guide flap is mounted on the first guide flap to pivot about a second axis parallel to the first axis, the second guide device further comprising a second locking device to rotatably lock the second guide flap relative to the first guide flap.

11. The excavation machine according to claim 10, comprising a second cylinder for pivoting the second guide flap relative to the first guide flap.

12. The excavation machine according to claim 8, wherein the second guide flap includes a plate, which is parallel to the longitudinal direction of the frame.

13. The excavation machine according to claim 8, wherein the first guide device further includes a pad disposed on a lateral edge of the second guide flap, the pad being provided to bear against a lateral face of a trench.

14. The excavation machine according to claim 1, further comprising a second guide device comprising at least a third guide flap protruding relative to the second lateral side of the frame outwardly of the frame, and wherein, considered in a plane perpendicular to the longitudinal direction of the frame, the third guide flap is inclined relative to the second lateral side of the frame.

15. The excavation machine according to claim 14, wherein the third guide flap is protruding from the lower part of the frame.

16. The excavation machine according to claim 14, further comprising a third guide device equipped with a fourth guide flap protruding relative to the first or second lateral side of the frame outwardly of the frame, and wherein, considered in a plane perpendicular to the longitudinal direction of the frame, the fourth guide flap is inclined relative to the first or the second lateral side of the frame, the fourth guide flap protruding from the upper part of the frame.

17. The excavation machine according to claim 1, wherein the excavation device includes a pair of movable scoops.

18. The excavation machine according to claim 1, wherein the excavation device includes at least one cutting drum which is rotatable about an axis of rotation perpendicular to the first main side of the frame.

19. A method for drilling a ground, comprising:

providing an excavation machine for making a trench in a ground including:

a frame extending along a longitudinal direction between a lower end part and an upper end part, the frame having a first main side, a second main side opposite to the first main side, a first lateral side and a second lateral side opposite to the first lateral side, the first and second main sides and the first and second lateral sides extending along the longitudinal direction of the frame, the first and second lateral sides being transverse to the first and second main sides, an excavation device disposed under the lower end part of the frame, wherein said excavation machine further includes at least a first guide device comprising at least a first guide flap that includes a plate protruding from the first lateral side of the frame outwardly of the frame, wherein, considered in a plane perpendicular to the longitudinal direction of the frame, the plate of the first guide flap is inclined relative to the first lateral side and wherein said plate is mounted on the frame to pivot about a first axis parallel to the longitudinal direction, the first guide device further comprising a first locking device to rotatably lock the plate of the first guide flap relative to the first lateral side to prevent the rotation of said plate relative to the first lateral side, thereby keeping the plate of the first guide flap at a constant inclination relative to the first lateral side of the frame;

drilling a first trench vertically into the ground, the first trench having a first main face which is vertical as well as a first lateral face which is vertical and orthogonal to the first main face; then drilling a ground portion vertically into the ground using said excavation machine, the plate of the first guide flap bearing against the first main face of the first trench during the drilling of the ground portion in order to keep the frame at a constant distance from said first main face, thereby preventing a deflection of the excavation device in a horizontal plane.

20. A method for drilling a ground, comprising:

providing an excavation machine for making a trench in a ground including:

a frame extending along a longitudinal direction between a lower end part and an upper end part, the frame having a first main side, a second main side opposite to the first main side, a first lateral side and a second lateral side opposite to the first lateral side, the first and second main sides and the first and second lateral sides extending along the longitudinal direction of the frame, the first and second lateral sides being transverse to the first and second main sides, an excavation device disposed under the lower end part of the frame, wherein said excavation machine further includes at least a first guide device comprising at least a first guide flap protruding from the first lateral side of the frame outwardly of the frame, and wherein, considered in a plane perpendicular to the longitudinal direction of the frame, the first guide flap is inclined relative to the first lateral side, wherein the first guide device further comprises a second guide flap connected to the first guide flap so that the first guide flap is disposed between the frame and the second guide flap, and wherein, considered in a plane perpendicular to the longitudinal direction of the frame, the second guide flap is inclined relative to the first guide flap;

drilling a first trench vertically into the ground, the first trench having a first main face and a first lateral face which is orthogonal to the first main face; then drilling a ground portion vertically by using said excavation machine, the second guide flap bearing against one or more of the main face and the first lateral face of the first trench during the drilling of the ground portion.

21. The drilling method according to claim 19, wherein after having drilled the first trench and before drilling the ground portion, drilling a second trench vertically into the ground, said second trench being separated from the first trench by the ground portion.

22. The drilling method according to claim 21, wherein, considered in a horizontal plane, the first and second trenches are inclined relative to each other.

23. An excavation machine for making a trench in a ground including:

a frame extending along a longitudinal direction between a lower end part and an upper end part, the frame having a first main side, a second main side opposite to the first main side, a first lateral side and a second lateral side opposite to the first lateral side, the first and second main sides and the first and second lateral sides extending along the longitudinal direction of the frame, the first and second lateral sides being transverse to the first and second main sides;

an excavation device disposed under the lower end part of the frame;

wherein said excavation machine further includes at least a first guide device comprising:

at least a first guide flap protruding from the first lateral side of the frame outwardly of the frame, wherein, considered in a plane perpendicular to the longitudinal direction of the frame, the first guide flap is inclined relative to the first lateral side; and a second guide flap connected to the first guide flap so that the first guide flap is disposed between the frame and the second guide flap, wherein, considered in a plane perpendicular to the longitudinal direction of the frame, the second guide flap is inclined relative to the first guide flap.

24. An excavation machine for making a trench in a ground including:

a frame extending along a longitudinal direction between a lower end part and an upper end part, the frame having a first main side, a second main side opposite to the first main side, a first lateral side and a second lateral side opposite to the first lateral side, the first and second main sides and the first and second lateral sides extending along the longitudinal direction of the frame, the first and second lateral sides being transverse to the first and second main sides;

an excavation device disposed under the lower end part of the frame; wherein said excavation machine further includes at least:

a first guide device comprising at least a first guide flap protruding from the first lateral side of the frame outwardly of the frame, wherein, considered in a plane perpendicular to the longitudinal direction of the frame, the first guide flap is inclined relative to the first lateral side;

a second guide device comprising at least a third guide flap protruding relative to the second lateral side of the frame outwardly of the frame, wherein, considered in a plane perpendicular to the longitudinal direction of the frame, the third guide flap is inclined relative to the second lateral side of the frame; and a third guide device equipped with a fourth guide flap protruding relative to the first or second lateral side of the frame outwardly of the frame, wherein, considered in a plane perpendicular to the longitudinal direction of the frame, the fourth guide flap is inclined relative to the first or the second lateral side of the frame, the fourth guide flap protruding from the upper part of the frame.

* * * * *